United States Patent [19]

DeLong

[11] Patent Number: 4,936,888

[45] Date of Patent: Jun. 26, 1990

[54] NITROGEN REJECTION UNIT

[75] Inventor: Bradley W. DeLong, West Columbia, Tex.

[73] Assignee: Phillips Petroleum Company, Bartlesville, Okla.

[21] Appl. No.: 454,659

[22] Filed: Dec. 21, 1989

[51] Int. Cl.[5] ..... F25J 3/02

[52] U.S. Cl. ..... 62/37; 62/24; 62/27; 62/31; 62/43

[58] Field of Search ..... 62/11, 24, 27, 31, 32, 62/36, 37, 43

[56] References Cited

U.S. PATENT DOCUMENTS

| | | | |
|---|---|---|---|
| 3,293,869 | 12/1966 | Karbosky et al. | 62/37 |
| 3,559,417 | 2/1971 | Hoffman | 62/24 |
| 4,225,329 | 9/1980 | Bailey et al. | 62/24 |
| 4,322,225 | 3/1982 | Bellinger et al. | 55/27 |
| 4,331,461 | 5/1982 | Karbosky et al. | 62/28 |
| 4,352,685 | 10/1982 | Swallow | 62/28 |
| 4,451,275 | 5/1984 | Vines et al. | 62/28 |
| 4,455,158 | 6/1984 | Vines et al. | 62/31 |
| 4,456,461 | 6/1984 | Perez | 62/28 |
| 4,592,767 | 6/1986 | Pahade et al. | 62/31 |
| 4,664,686 | 5/1987 | Pahade et al. | 62/24 |
| 4,666,483 | 5/1987 | Gauthier | 62/24 |
| 4,711,651 | 12/1987 | Sharma et al. | 62/24 |
| 4,746,342 | 5/1988 | DeLong et al. | 62/24 |
| 4,767,428 | 8/1988 | Apffel | 62/24 |

OTHER PUBLICATIONS

Looney, S. K., et al., Technology, Oil and Gas Journal, 12-17-84, pp. 103-108.

*Primary Examiner*—Ronald C. Capossela
*Attorney, Agent, or Firm*—George E. Bogatie

[57] ABSTRACT

An improved apparatus and process are disclosed for nitrogen rejection from a gaseous hydrocarbon stream recovered from an enhanced oil recovery project employing nitrogen for miscible flood of oil reservoirs. The process utilizes a modified dual distillation column arrangement including two fractionators which do not utilize overhead reflux condensers or reboilers for separating a nitrogen-methane mixture. Further, process conditions can be adjusted so as to provide efficient nitrogen rejection from a feedstream in which nitrogen content varies widely over a comparatively long period of time during enhanced recovery of oil.

11 Claims, 1 Drawing Sheet

NITROGEN REJECTION UNIT

This invention relates to separating nitrogen and hydrocarbons in a normally gaseous mixture containing nitrogen in variable amounts. In one aspect it relates to a process employing a modified dual distillation column arrangement for rejecting nitrogen from a gaseous stream. In another aspect it relates to an improved method for recovering nitrogen from a hydrocarbon stream containing Cz and heavier hydrocarbon components.

BACKGROUND OF THE INVENTION

Interest in separation and recovery of nitrogen from a hydrocarbon gas stream, which contains variable amounts of nitrogen, comes primarily from recovery of nitrogen from gas streams associated with enhanced oil recovery (EOR) projects employing nitrogen for miscible flood of oil reservoirs. In these miscible flooding projects a nitrogen rejection unit (NRU) for producing a nitrogen product pure enough to allow the recovered nitrogen to be reinjected into the oil reservoir is required. In addition, the NRU must have capacity for handling the gaseous feed mixture with a minimum of equipment changes while the nitrogen content of the recovered gas changes widely during the comparatively long life of the enhanced recovery project.

In response to the nitrogen recovery problem associated with enhanced oil recovery projects, several methods of separating nitrogen from the hydrocarbons have been developed. A commonly used method employs an integrated dual distillation column arrangement in which a high pressure column provides a rough nitrogen/methane split and a low pressure column makes the specification product. Generally these prior art methods have been designed for gaseous mixtures having a relatively low concentration of heavy hydrocarbons and/or a relatively unchanging nitrogen concentration in the gaseous mixture being processed, and would require equipment changes during the duration of the enhanced oil recovery project to accommodate the changing levels of nitrogen present in the gas to be processed.

Accordingly, it is an object of this invention to provide an improved integrated dual distillation apparatus and process for removing nitrogen from a gaseous mixture containing nitrogen and hydrocarbon components.

It is another object of this invention to provide an improved process for removing nitrogen from natural gas wherein the nitrogen concentration in the natural gas may vary from the naturally occurring concentration to as high as 75 mole-% or more.

It is yet another object of this invention to provide an improved process for removing nitrogen from natural gas wherein the natural gas also contains a relatively high concentration of heavy hydrocarbons.

It is yet another object of this invention to provide an improved method of recovering nitrogen from a miscible flooding project wherein the nitrogen is recovered as a substantially pure gaseous product.

It is yet another object of this invention to provide a process and apparatus for removing nitrogen from natural gas that is suitable for offshore operations.

BRIEF SUMMARY OF THE INVENTION

In treating a miscible flood gas stream, an improved process for separating gaseous nitrogen and methane is disclosed. As used herein a miscible flood gas is a mixture containing nitrogen, methane, ethane, and some heavier hydrocarbon components, wherein the nitrogen content can vary widely over the comparatively long life of an enhanced oil recovery project.

In accordance with the present invention, there is provided an improved process and apparatus for an integrated dual distillation system which is advantageous for offshore operations. The process for separating nitrogen from methane in a distillation system employing a high pressure (HP) fractionator and a low pressure (LP) fractionator comprises the steps of:

(a) cooling a first portion of a first stream, essentially free of heavy hydrocarbons, and comprising a gaseous nitrogen-methane mixture at a pressure of at least 450 psia, so as to produce a partially condensed first portion of said first stream;

(b) separating said partially condensed first portion of said first stream in a first phase separator and withdrawing from said first separator a second stream having an actual temperature, comprising gaseous nitrogen-methane and a third stream comprising liquid nitrogen-methane, wherein said second stream is enriched in nitrogen and said third stream is enriched in methane;

(c) cooling said second stream sufficiently so as to produce a partially condensed second stream prior to introducing said partially condensed second stream into an upper portion of said HP fractionator;

(d) combining a second portion of said first stream with said third stream to form a fourth stream;

(e) feeding said fourth stream into a lower portion of said HP fractionator wherein said partially condensed second stream and said fourth stream are simultaneously fractionated in said HP fractionator to produce a fifth stream predominantly comprising gaseous nitrogen and a sixth stream predominantly comprising liquid methane;

(f) cooling said fifth stream sufficiently so as to produce a partially condensed condense fifth stream;

(g) separating said partially condensed fifth stream in a second phase separator and withdrawing from said second separator a seventh stream predominantly comprising liquid nitrogen and an eighth stream predominantly comprising gaseous nitrogen;

(h) feeding said seventh stream into a middle portion of said LP fractionator;

(i) expanding at least a portion of said eighth stream prior to feeding said eighth stream into an upper portion of said LP fractionator;

(j) combining a third portion of said first stream with said sixth stream to form a ninth stream;

(k) feeding said ninth stream into a lower portion of said LP fractionator and simultaneously fractionating said seventh stream, said eighth stream and said ninth stream in said LP fractionator under conditions sufficient to produce a high purity nitrogen overhead stream and a high purity methane bottom stream;

(l) recovering said overhead stream from said LP fractionator as a nitrogen product stream; and (m) recovering said bottom stream from said LP fractionator as a gas product stream.

In a preferred embodiment of the present invention heavy hydrocarbons are removed from a miscible flood gas and the flood gas, essentially free of heavy hydrocarbons, is passed to a dual distillation system. The dual distillation system includes two fractionator columns which do not utilize overhead reflux condensers, or reboilers for separating the nitrogen-methane mixture. Further in accordance with the present invention certain process conditions can be adjusted so as to provide efficient nitrogen rejection from a feedstream whose nitrogen content may vary from a low of about 37 mole-% to a high of about 76 mole-%.

Further aspects and additional advantages of the invention will be apparent from the following detailed description of the preferred embodiment of the invention as illustrated by the drawings in which:

DETAILED DESCRIPTION OF THE PREFERRED EMBODIMENT

Figure 1:
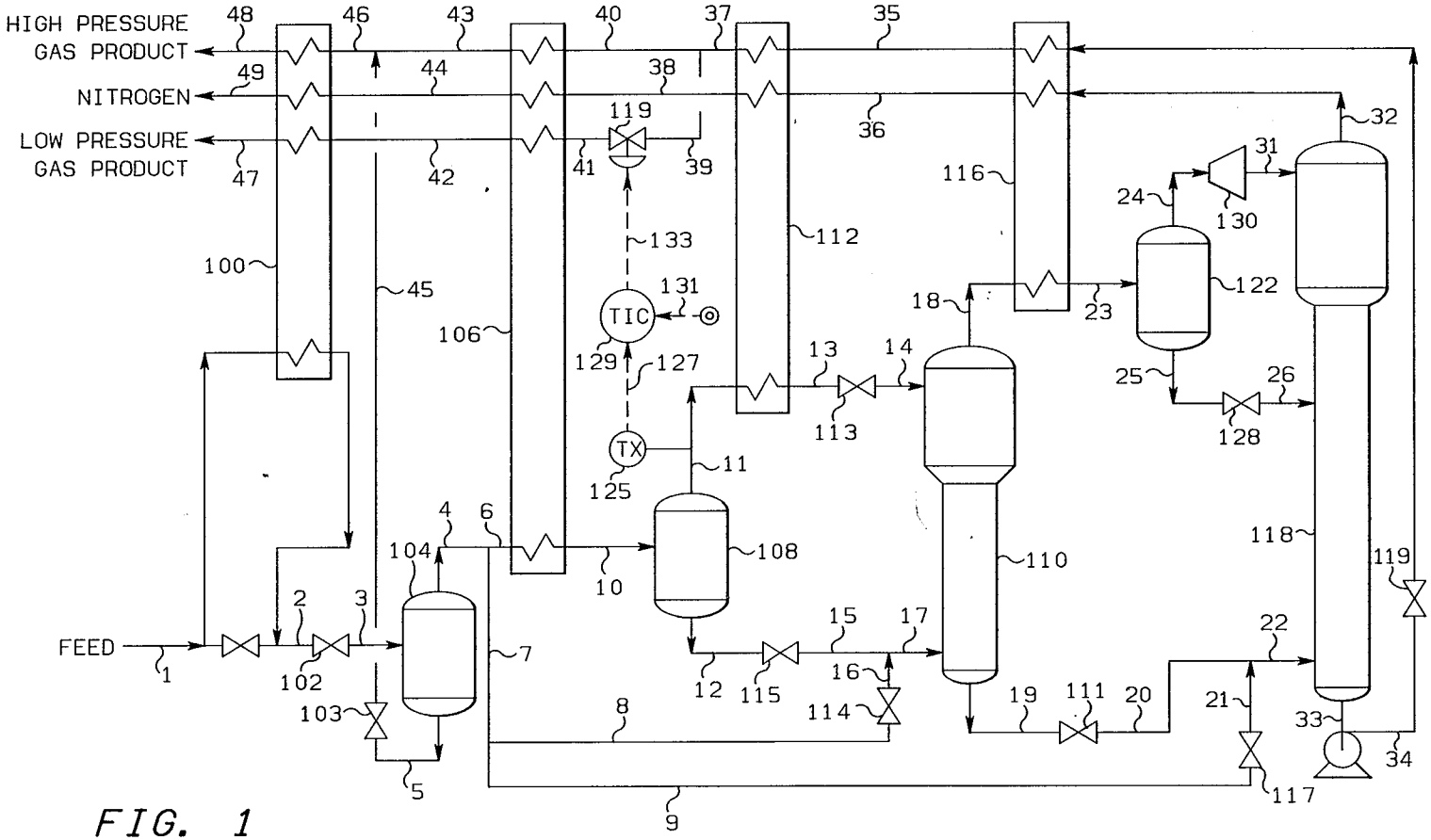
FIG. 1 is a schematic diagram illustrating process flow of the dual distillation column process for nitrogen rejection according to this invention.

It will be appreciated by those skilled in the art that, since FIG. 1 is schematic only, many items of equipment which would be needed for successful operation of a commercial plant have been omitted for the sake of clarity. Such items of equipment would include, for example, additional temperature, flow and pressure measurement instruments and corresponding process controllers, pumps, compressors, additional heat exchangers, valves, etc. All these items would be provided in accordance with standard chemical engineering practice to maintain desired conditions throughout the process and are not necessary to describe the present invention.

The present invention is applicable to recovering nitrogen from a gaseous mixture in which the nitrogen content varies widely and wherein the gaseous mixture contains a significant concentration of $C_2$ and higher molecular weight hydrocarbon components. It is particularly applicable to treating miscible flood gas produced from enhanced oil recovery in an offshore operation. This flood gas recovery results in processing a gas having considerable nitrogen dilution, with a nitrogen concentration often in excess of 70 mole-%, and also having a significant concentration of $C_2$ and higher molecular weight hydrocarbons.

It should also be understood that the representative temperatures and pressures set forth herein, with relation to the description of the drawing and the examples, are illustrative only and are not to be considered as limiting. The particular temperatures and pressures utilized in a particular separation will be dependent upon the nature and composition of the feed stream, upon the particular heat exchange surface areas available and upon the initial temperatures and pressures of the feed stream.

Referring now to FIG. 1, a feed gas stream containing methane and nitrogen, and having a significant concentration of $C_2$ and heavier hydrocarbons, at a pressure above 450 psia and preferably at about 800 psia or more is fed to the nitrogen rejection system through conduit 1. The feed gas stream could have for its origin, for example, a gas stream produced in a miscible flooding for enhanced oil recovery, in which case it would contain a high and variable nitrogen loading, which could increase to 76 mole-% or more during the life of the EOR project, along with a significant concentration of $C_2$ and heavier hydrocarbons. In accordance with standard practice, other easily condensible contaminants such as $CO_2$ or $H_2S$ which may be found in a gas produced in a miscible flooding would be removed by, for example, an absorption process prior to entering the nitrogen rejection process via conduit 1. Generally the nitrogen concentration of the feed gas stream 1 varies from about 40 mole-% to about 70 mole-% over the life of the EOR project.

The feed gas flowing in conduit 1 is divided so that a portion of the feed gas is cooled in chiller 100 by heat exchange with cooled exiting gas streams. Chiller 100 is bypassed, and the warm feed gas flowing in the bypass conduit is combined with the gas cooled in chiller 100 to form a combined stream in conduit 2 which is blended to a temperature of about −60° F. The cooled and partially condensed gas flowing in conduit 2 is passed through valve 102 and is then passed to a liquid/vapor phase separator 104 and separated into a vapor phase and a liquid phase. From separator 104 a liquid stream containing heavy hydrocarbons is withdrawn through conduit 5 and a vapor stream is withdrawn through conduit 4. The liquid discharged from separator 104 is preferably manipulated by liquid level control valve 103 in response to the actual liquid level in separator 104. The condensed heavy hydrocarbon stream flowing in conduit 5 is combined with the predominantly methane stream exiting the nitrogen rejection system in conduit 43 as will be explained more fully hereinafter. The uncondensed vapor stream in conduit 4, essentially free of heavy hydrocarbons, is the feedstream to the dual distillation system. This feedstream is divided so that a portion of the vapor flowing in conduit 4 is passed to conduit 6 and is cooled and partially condensed by heat exchange with cooled exiting gas streams in chiller 106.

The temperature of the cooled and partially condensed gas exiting chiller 106 in conduit 10 is reduced when the nitrogen content of the feed gas increases as will be further described hereinafter. The cooled and partially condensed gas flowing in conduit 10 is passed to a phase separator 108 and separated into a vapor phase and a liquid phase. From separator 108 a condensed liquid stream is withdrawn through conduit 12 and passed through expansion/control valve 115 to a lower portion of the high pressure (HP) fractionator 110 An uncondensed vapor stream is withdrawn from separator 108 through conduit 11. The liquid discharged from separator 108 is preferably manipulated through control valve 115 in response to the actual liquid level in separator 108. The uncondensed vapor stream flowing in conduit 11 is cooled in chiller 112 by heat exchange with cooled exiting gas streams. The cooled and partially condensed gas stream exiting chiller 112 in conduit 13 is further cooled in passing through an expansion device, such as expansion valve 113, and into conduit 14 from where the partially condensed gas is fed to a tray in the upper portion of the HP fractionator 110.

Chillers 106 and 112 and separator 108 are bypassed by the combination of conduits 7, 8, and 16 and expansion valve 114. A portion of the uncondensed vapor flowing in conduit 4, which is passed through expansion valve 114 via conduits 7 and 8 is cooled and partially condensed in passing through valve 114, or other similar expansion device, into conduit 16. The predominantly vapor stream flowing in conduit 16 is combined with the liquid stream flowing in conduit 15 and enters the bottom of the HP fractionator in mixture with the liquid supplied in conduit 15 via conduit 17. The predominantly vapor stream is provided via conduit 8 to the lower portion of HP fractionator 110 so as to increase stripping vapors provided to HP fractionator 110 thereby increasing the amount of nitrogen rejected by the fractionator 110.

The HP fractionator 110 produces an overhead fraction of nitrogen-enriched gas which is withdrawn through conduit 18, and a bottoms fraction of methane-enriched liquid which is withdrawn through conduit 19. The nitrogen enriched vapor stream flowing in conduit 18 is cooled sufficiently in chiller 116 by heat exchange with cooled exiting streams so as to partially condense the gaseous nitrogen flowing in conduit 18. The thus cooled and partially condensed gas exits chiller 116 via conduit 23 and is passed to phase separator 122 and separated into a vapor phase and a liquid phase. A liquid stream is withdrawn from separator 122 through conduit 25 and passed through control/expansion valve 128 into conduit 26 where the pressure is reduced so as to effect flashing of the liquid which is fed to a tray at or near the middle tray of the LP fractionator 118. The liquid discharged from separator 122 is preferably manipulated by liquid level control/expansion valve 128 in response to the actual liquid level in separator 122.

An uncondensed vapor stream is withdrawn from separator 122 via conduit 24 and is passed to an expander, or similar expansion means, 130. The thus expanded and partially condensed vapors are withdrawn from expander 130 via conduit 31 and introduced into an upper portion of LP fractionator 118 as the main feed stream for LP fractionator 118. The bottoms stream from HP fractionator 110 is withdrawn in conduit 19 and expanded across control/expansion valve 111 into conduit 20 and then combined with a third portion of the feedstream flowing in conduit 4 which flow through the combination of conduits 4, 7, 9, and 21, and expansion/control valve 117. Preferably the bottoms temperature of LP fractionator 118 is controlled by manipulating valve 117. The thus combined stream flowing in conduit 22 is fed to a lower portion of the LP fractionator 118. The feed entering fractionator 118 via conduits 31, 26, and 22 is simultaneously fractionated under conditions sufficient to produce a high purity nitrogen stream withdrawn in conduit 32 and a high purity methane stream withdrawn in conduit 33.

The high purity overhead nitrogen product stream and the high purity methane product are withdrawn from LP fractionator 118 at a pressure level of about 50 psia via conduits 32 and 33 respectively. The high purity methane stream flowing in conduit 33 is elevated in pressure and provided to conduit 34. The liquid discharged from LP fractionator 118 is preferably manipulated by liquid level control valve 119 in response to the actual liquid level in fractionator 118.

In a preferred embodiment of the invention, the cooled exiting streams flowing in conduits 32 and 34 are utilized to provide the refrigeration necessary in the separation steps by countercurrent flow heat exchange with incoming or internal streams in the nitrogen rejection system. Additional cooling for the feed streams in chillers 106 and 100 is provided by depressurizing the portion of the LP fractionator 118 bottoms stream flowing in conduit 37, as will be described more fully hereinafter.

The high purity nitrogen stream flowing from LP fractionator 118 in conduit 32 is heated in chiller 116 by countercurrent flow heat exchange with the overhead nitrogen stream from HP fractionator 110 which is flowing in conduit 18. The high purity nitrogen stream exits chiller 116 in conduit 36 and is then further heated in chillers 112, 106 and 100.

The high purity methane stream from LP fractionator 118 flowing in conduit 34 is heated by countercurrent flow heat exchange with an internal stream in chillers 116 and 112. After exiting chiller 112 via conduit 37 the high purity methane stream is divided. A portion of the stream flowing in conduit 37 is supplied to conduit 39 and is depressurized and cooled in passing through control/expansion valve 119 which is operably connected between conduits 39 and 41. The thus expanded stream enters chiller 106 via conduit 41 where it is further heated and passed to chiller 100 via conduit 42 where it is still further heated and essentially vaporized in chiller 100 before exiting chiller 100 in conduit 47 as the low pressure gas product stream.

The remaining portion of the stream flowing in conduit 37 is supplied to conduit 40 and enters chiller 106 where it is heated and partially vaporized by countercurrent flow heat exchange with the feed stream flowing in conduit 6. On exiting chiller 106 in conduit 43, this stream is combined with the heavy hydrocarbon liquid stream discharged from separator 104 via conduits 5 and 45. The liquid discharged from separator 104 is preferably manipulated by a liquid level control valve 103 which is operably located between conduits 5 and 45. The thus combined stream flowing in conduit 46 is heated and essentially vaporized in chiller 100, and on exiting chiller 100 is provided as a high pressure gas product stream via conduit 48.

Further in accordance with the present invention the temperature of the vapor stream withdrawn from separator 108 in conduit 11 is controlled to a desired value. Specifically, as illustrated in the examples set forth hereinafter, the desired value for the temperature of the vapor flowing in conduit 11 will decrease as the nitrogen content of the feed gas increases during the life of the EOR project.

A specific temperature control loop is set forth in FIG. 1 for illustration. The invention extends, however, to different types of control configurations which accomplish the purpose of the invention. Dash lines designated as signal lines in the drawing are electrical or pneumatic in this preferred embodiment.

The temperature controller 129 illustrated in FIG. 1 may utilize the various modes of control such as proportional, proportional-integral, or proportional-integral-derivative. In this preferred embodiment, proportional-integral modes are preferred but any controller having the capacity for accepting two input signals and providing a scaled output signal representative of a comparison of the two input signals is within the scope of this invention.

The scaling of a controller output signal is well known in the control system art. Essentially, the output of a controller may be scaled to represent any desired factor or variable. An example of this is where a desired temperature and an actual (measured) temperature are compared by a controller. The controller output could be a signal representative of a change in the flow rate of some gas stream necessary to make the desired and actual temperatures equal. On the other hand, the same output signal could be scaled to represent a percentage change. If the controller output can range from 0 to 10 volts, which is common, then the output signal could be scaled so that an output signal having a voltage level of 5 volts corresponds to 50 percent, some specific flow rate or some specific temperature.

In a preferred embodiment for a closed temperature control loop, a temperature transducer 125 in combination with a temperature measuring device such as a thermocouple which is operably located in conduit 11 provides an output signal 127 which is representative of the actual temperature of the vapor stream flowing in conduit 11. Signal 127 is provided from the flow transducer 125 as the process variable input to the PID (proportional-integral-derivative) temperature controller 129. The PID temperature controller 129 is also provided with a set point signal 131 which is representative of the desired temperature of the vapor flowing in conduit 11. Signal 131 may be an operator entered temperature value for a temperature which is substantially constantly maintained for the vapor flowing in conduit 11, or the signal 131 may be provided from a supervisory control computer, not illustrated in FIG. 1.

In response to signals 127 and 131 the temperature controller 129 provides an output signal 133 which is representative of the difference between signals 127 and 131. Signal 133 is scaled so as to be representative of the position of control valve 119 which is operably located between between conduits 39 and 41 required to maintain the actual temperature of the vapor flowing in conduit 11 substantially equal to the desired temperature represented by signal 131. Signal 133 is provided from temperature controller 129 as a control signal to control valve 119, and the control valve 119 is manipulated in response thereto.

In this manner the desired temperature of the vapor in conduit 11 is maintained by manipulating the division of the gas product between the low pressure gas product provided via conduit 47 and the high pressure gas product provided via conduit 48. As has been previously stated the desired temperature for the vapor in conduit 11 is generally reduced as the nitrogen content of miscible flood gas increases during the life of the EOR project.

The following examples are presented in further illustration of the invention and are not to be considered as unduly limiting the scope of this invention.

EXAMPLE 1

This example illustrates nitrogen rejection from a gaseous stream containing about 40 mole-% nitrogen according to the improved process of this invention. The feed stream 1 is a gaseous stream having a composition which might be found in a gas stream actually produced in a reservoir flood during a relatively early stage of an EOR project.

Table 1, below, shows the composition, temperature, pressure, vapor fraction and mass flow rate which were calculated from heat and material balance considerations. The numbers in the left hand column of Table 1 refer to the reference numerals of the conduits (or equivalently streams) illustrated in the drawing FIG. 1.

TABLE 1

| Conduit/ | Mole Fraction | | | | | | °F. | psia | lb/day | Vapor |
|---|---|---|---|---|---|---|---|---|---|---|
| Stream | N2 | C1 | C2 | C3 | i-C4 | n-C4 | Temp | Press | Flow | Fraction |
| 1 | 0.360 | 0.556 | 0.055 | 0.020 | 0.002 | 0.005 | −80 | 880 | .569E+07 | 1.0 |
| 2 | 0.360 | 0.556 | 0.055 | 0.020 | 0.002 | 0.005 | −60 | 880 | .569E+07 | 0.963 |
| 3 | 0.360 | 0.556 | 0.055 | 0.020 | 0.002 | 0.005 | −70 | 700 | .569E+07 | 0.957 |
| 4 | 0.374 | 0.567 | 0.047 | 0.010 | 0.001 | 0.001 | −70 | 700 | .531E+07 | 1.0 |
| 5 | 0.050 | 0.307 | 0.235 | 0.249 | 0.041 | 0.089 | −70 | 700 | .380E+06 | 0 |
| 6 | 0.374 | 0.567 | 0.047 | 0.010 | 0.001 | 0.001 | −70 | 700 | .531E+07 | 1.0 |
| 7 | 0 | 0 | 0 | 0 | 0 | 0 | −70 | 700 | — | 1.0 |
| 8 | 0 | 0 | 0 | 0 | 0 | 0 | — | — | — | — |
| 9 | 0 | 0 | 0 | 0 | 0 | 0 | — | — | — | — |
| 10 | 0.374 | 0.567 | 0.047 | 0.010 | 0.001 | 0.001 | −169 | 700 | .531E+07 | 0 |
| 11 | 0.602 | 0.392 | 0.006 | 0 | 0 | 0 | −169 | 690 | .253E+06 | 1.0 |
| 12 | 0.364 | 0.575 | 0.049 | 0 | 0.001 | 0.001 | −169 | 690 | .505E+07 | 0 |
| 13 | 0.602 | 0.392 | 0.006 | 0 | 0 | 0 | −207 | 690 | .255E+06 | 0 |
| 14 | 0.602 | 0.392 | 0.006 | 0 | 0 | 0 | −230 | 290 | .253E+06 | 0.256 |
| 15 | 0.364 | 0.575 | 0.049 | 0.011 | 0.001 | 0.001 | −203 | 290 | .505E+07 | 0.366 |
| 16 | 0 | 0 | 0 | 0 | 0 | 0 | — | 290 | — | — |
| 17 | 0.364 | 0.575 | 0.049 | 0.001 | 0.011 | 0.001 | −203 | 290 | .505E+07 | 0.366 |
| 18 | 0.674 | 0.326 | 0 | 0 | 0 | 0 | −209 | 290 | .220E+07 | 1.0 |
| 19 | 0.198 | 0.709 | 0.075 | 0.016 | 0.001 | 0.001 | −203 | 290 | .311E+07 | 0 |
| 20 | 0.198 | 0.709 | 0.075 | 0.016 | 0.001 | 0.001 | −248 | 50 | .311E+07 | 0.264 |
| 21 | 0 | 0 | 0 | 0 | 0 | 0 | — | 50 | — | — |
| 22 | 0.198 | 0.709 | 0.075 | 0.016 | 0.001 | 0.001 | −274 | 50 | .311E+07 | 0.264 |
| 23 | 0.674 | 0.326 | 0 | 0 | 0 | 0 | −228 | 290 | .220E+07 | 0.529 |
| 24 | 0.832 | 0.168 | 0 | 0 | 0 | 0 | −228 | 280 | .136E+07 | 1.0 |
| 25 | 0.463 | 0.537 | 0 | 0 | 0 | 0 | −228 | 280 | .843E+06 | 0 |
| 26 | 0.463 | 0.537 | 0 | 0 | 0 | 0 | −277 | 50 | .843E+06 | 0.311 |
| 31 | 0.832 | 0.168 | 0 | 0 | 0 | 0 | −280 | 50 | .136E+07 | 0.858 |
| 32 | 0.843 | 0.157 | 0 | 0 | 0 | 0 | −270 | 50 | .258E+07 | 1.0 |
| 33 | 0.060 | 0.842 | 0.079 | 0.017 | 0.001 | 0.001 | −248 | 50 | .272E+07 | 0 |
| 34 | 0.060 | 0.842 | 0.079 | 0.017 | 0.001 | 0.001 | −250 | 540 | .272E+07 | 0 |
| 35 | 0.060 | 0.842 | 0.079 | 0.017 | 0.001 | 0.001 | −213 | 540 | .272E+07 | 0 |
| 36 | 0.843 | 0.157 | 0 | 0 | 0 | 0 | −213 | 50 | .258E+07 | 1.0 |
| 37 | 0.060 | 0.842 | 0.079 | 0.017 | 0.001 | 0.001 | −207 | 540 | .272E+07 | 0 |
| 38 | 0.843 | 0.157 | 0 | 0 | 0 | 0 | −207 | 50 | .258E+07 | 1.0 |
| 39 | 0.060 | 0.842 | 0.079 | 0.017 | 0.001 | 0.001 | −207 | 540 | .136E+07 | 0 |
| 40 | 0.060 | 0.842 | 0.079 | 0.017 | 0.001 | 0.001 | −207 | 540 | .136E+07 | 0 |
| 41 | 0.060 | 0.842 | 0.079 | 0.017 | 0.001 | 0.001 | −206 | 190 | .136E+07 | 0 |
| 42 | 0.060 | 0.842 | 0.079 | 0.017 | 0.001 | 0.001 | −92 | 190 | .136E+07 | 0.987 |
| 43 | 0.060 | 0.842 | 0.079 | 0.017 | 0.001 | 0.001 | −92 | 540 | .136E+07 | 0.895 |
| 44 | 0.843 | 0.157 | 0 | 0 | 0 | 0 | −92 | 50 | .258E+07 | 1.0 |
| 45 | 0.050 | 0.307 | 0.235 | 0.249 | 0.041 | 0.089 | −75 | 510 | .379E+06 | 0.077 |
| 46 | 0.059 | 0.772 | 0.099 | 0.047 | 0.006 | 0.013 | −86 | 510 | .174E+07 | 0.757 |

TABLE 1-continued

| Conduit/ Stream | Mole Fraction N2 | C1 | C2 | C3 | i-C4 | n-C4 | °F. Temp | psia Press | lb/day Flow | Vapor Fraction |
|---|---|---|---|---|---|---|---|---|---|---|
| 47 | 0.060 | 0.842 | 0.079 | 0.017 | 0.001 | 0.001 | 54 | 190 | .146E+07 | 1.0 |
| 48 | 0.059 | 0.772 | 0.099 | 0.047 | 0.006 | 0.013 | 54 | 510 | .174E+07 | 1.0 |
| 49 | 0.843 | 0.157 | 0 | 0 | 0 | 0 | 54 | 80 | .258E+07 | 1.0 |

EXAMPLE 2

This example illustrates nitrogen rejection from a gaseous stream containing about 76 mole-% nitrogen according to the improved process of this invention. The feed stream 1 is a gaseous stream having a composition which might be found in a gas stream actually produced in a reservoir flood during a relatively late stage of an EOR project.

Table 2 shows the composition, temperature, pressure, vapor fraction and mass flow rate which were calculated from heat and material balance considerations. The numbers in the left hand column of Table 2 refer to the reference numerals of the conduits (or equivalently streams) illustrated in the drawing FIG. 1.

TABLE 2

| Conduit/ Stream | Mole Fraction N2 | C1 | C2 | C3 | i-C4 | n-C4 | °F. Temp | psia Press | lb/day Flow | Vapor Fraction |
|---|---|---|---|---|---|---|---|---|---|---|
| 1 | 0.763 | 0.201 | 0.021 | 0.009 | 0.001 | 0.003 | 80 | 880 | .507E+08 | 1.0 |
| 2 | 0.763 | 0.201 | 0.021 | 0.009 | 0.001 | 0.003 | −60 | 880 | .507E+08 | 0.993 |
| 3 | 0.763 | 0.201 | 0.201 | 0.009 | 0.001 | 0.003 | −68 | 700 | .507E+08 | 0.992 |
| 4 | 0.768 | 0.202 | 0.020 | 0.007 | 0.001 | 0.001 | −68 | 700 | .499E+08 | 1.0 |
| 5 | 0.069 | 0.093 | 0.114 | 0.245 | 0.078 | 0.227 | −68 | 700 | .772E+06 | 0 |
| 6 | 0.768 | 0.202 | 0.020 | 0.007 | 0.001 | 0.001 | −68 | 700 | .434E+08 | 1.0 |
| 7 | 0.768 | 0.202 | 0.020 | 0.007 | 0.001 | 0.001 | −68 | 700 | .648E+07 | 1.0 |
| 8 | 0.768 | 0.202 | 0.020 | 0.007 | 0.001 | 0.001 | −68 | 700 | .195E+07 | 1.0 |
| 9 | 0.768 | 0.202 | 0.020 | 0.007 | 0.001 | 0.001 | −68 | 700 | .454E+07 | 1.0 |
| 10 | 0.768 | 0.202 | 0.020 | 0.007 | 0.001 | 0.001 | −183 | 700 | .434E+08 | 0.950 |
| 11— | 0.798 | 0.195 | 0.007 | 0 | 0 | 0 | −183 | 690 | .410E+08 | 1.0 |
| 12 | 0.209 | 0.337 | 0.278 | 0.137 | 0.013 | 0.023 | −183 | 690 | .238E+07 | 0 |
| 13 | 0.798 | 0.195 | 0.007 | 0 | 0 | 0 | −194 | 690 | .410E+08 | 1.0 |
| 14 | 0.798 | 0.195 | 0.007 | 0 | 0 | 0 | −230 | 290 | .410E+08 | 0.809 |
| 15 | 0.209 | 0.331 | 0.278 | 0.137 | 0.013 | 0.023 | −197 | 290 | .238E+07 | 0.169 |
| 16 | 0.768 | 0.202 | 0.020 | 0.007 | 0.001 | 0.001 | −92 | 290 | .195E+07 | 0.998 |
| 17 | 0.472 | 0.273 | 0.157 | 0.076 | 0.007 | 0.013 | −173 | 290 | .433E+07 | 0.631 |
| 18 | 0.868 | 0.131 | 0 | 0 | 0 | 0 | −230 | 290 | .385E+08 | 1.0 |
| 19 | 0.282 | 0.545 | 0.118 | 0.043 | 0.004 | 0.007 | −222 | 290 | .682E+07 | 0 |
| 20 | 0.282 | 0.545 | 0.118 | 0.043 | 0.004 | 0.007 | −263 | 50 | .682E+07 | 0.261 |
| 21 | 0.768 | 0.202 | 0.020 | 0.007 | 0.001 | 0.001 | −112 | 50 | .454E+07 | 1.0 |
| 22 | 0.462 | 0.418 | 0.082 | 0.030 | 0.003 | 0.005 | −251 | 50 | .114E+08 | 0.628 |
| 23 | 0.868 | 0.131 | 0 | 0 | 0 | 0 | −237 | 290 | .385E+08 | 0.863 |
| 24 | 0.896 | 0.104 | 0 | 0 | 0 | 0 | −237 | 280 | .350E+08 | 1.0 |
| 25 | 0.621 | 0.377 | 0.002 | 0 | 0 | 0 | −237 | 280 | .347E+07 | 0 |
| 26 | 0.621 | 0.377 | 0.002 | 0 | 0 | 0 | −287 | 50 | .347E+07 | 0.309 |
| 31 | 0.896 | 0.104 | 0 | 0 | 0 | 0 | −289 | 50 | .350E+08 | 0.842 |
| 32 | 0.963 | 0.037 | 0 | 0 | 0 | 0 | −289 | 50 | .413E+08 | 1.0 |
| 33 | 0.095 | 0.773 | 0.091 | 0.032 | 0.003 | 0.005 | −260 | 50 | .856E+07 | 0 |
| 34 | 0.095 | 0.773 | 0.091 | 0.032 | 0.003 | 0.005 | −261 | 540 | .856E+07 | 0 |
| 35 | 0.095 | 0.773 | 0.091 | 0.032 | 0.003 | 0.005 | −239 | 540 | .856E+07 | 0 |
| 36 | 0.963 | 0.037 | 0 | 0 | 0 | 0 | −239 | 50 | .413E+08 | 1.0 |
| 37 | 0.095 | 0.773 | 0.091 | 0.032 | 0.003 | 0.005 | −205 | 540 | .856E+07 | 0 |
| 38 | 0.963 | 0.037 | 0 | 0 | 0 | 0 | −205 | 50 | .413E+08 | 1.0 |
| 39 | 0.095 | 0.773 | 0.091 | 0.032 | 0.003 | 0.005 | −205 | 540 | .299E+07 | 0 |
| 40 | 0.095 | 0.773 | 0.091 | 0.032 | 0.003 | 0.005 | −205 | 540 | .556E+07 | 0 |
| 41 | 0.095 | 0.773 | 0.091 | 0.032 | 0.003 | 0.005 | −204 | 190 | .299E+07 | 0.007 |
| 42 | 0.095 | 0.773 | 0.091 | 0.032 | 0.003 | 0.005 | −97 | 190 | .299E+07 | 0.934 |
| 43 | 0.095 | 0.773 | 0.091 | 0.032 | 0.003 | 0.005 | −97 | 540 | .556E+07 | .788 |
| 44 | 0.963 | 0.037 | 0 | 0 | 0 | 0 | −97 | 50 | .413E+08 | 1.0 |
| 45 | 0.069 | 0.093 | 0.114 | 0.245 | 0.078 | 0.227 | −68 | 510 | .772E+06 | 0.037 |
| 46 | 0.094 | 0.737 | 0.092 | 0.044 | 0.007 | 0.017 | −94 | 510 | .633E+07 | .737 |
| 47 | 0.095 | 0.773 | 0.091 | 0.032 | 0.003 | 0.005 | 44 | 190 | .299E+07 | 1.0 |
| 48 | 0.094 | 0.737 | 0.092 | 0.044 | 0.007 | 0.017 | 44 | 510 | .633E+07 | .990 |
| 49 | 0.963 | 0.031 | 0 | 0 | 0 | 0 | 44 | 80 | .413E+08 | 1.0 |

The results indicated in Tables 1 and 2 show that the process of this invention maintains sufficient separation for feed streams widely varying in nitrogen content by maintaining the indicated process conditions, and that the inventive process will allow the use of nitrogen rejection units for providing sufficiently pure nitrogen for reinjecting in an EOR project. Further, the elimination of overhead reflux condensers and reboilers on the fractionators make them extremely simple to operate and therefore more suitable for offshore operations.

It is to be understood that reasonable variations and modifications for various usages and conditions are possible by those skilled in the art, and such modifications and variations are within the scope of the described invention and the appended claims.

That which is claimed is:

1. A process for separating nitrogen from methane in a distillation system employing a high pressure (HP) fractionator and a low pressure (LP) fractionator, said process comprising the steps of:

(a) cooling a first portion of a first stream, essentially free of heavy hydrocarbons, and comprising a gaseous nitrogen-methane mixture at a pressure of at least 450 psia, so as to produce a partially condensed first portion of said first stream;

(b) separating said partially condensed first portion of said first stream in a first phase separator and withdrawing from said first separator a second stream, having an actual temperature, comprising gaseous nitrogen-methane and a third stream comprising liquid nitrogen-methane, wherein said second stream is enriched in nitrogen and said third stream is enriched in methane;

(c) cooling said second stream sufficiently so as to produce a partially condensed second stream prior to introducing said partially condensed second stream into an upper portion of said HP fractionator;

(d) combining a second portion of said first stream with said third stream to form a fourth stream;

(e) feeding said fourth stream into a lower portion of said HP fractionator wherein said partially condensed second stream and said fourth stream are simultaneously fractionated in said HP fractionator to produce a fifth stream predominantly comprising gaseous nitrogen and a sixth stream predominantly comprising liquid methane;

(f) cooling said fifth stream sufficiently so as to produce a partially condensed fifth stream;

(g) separating said partially condensed fifth stream in a second phase separator and withdrawing from said second phase separator a seventh stream predominantly comprising liquid nitrogen and an eighth stream predominantly comprising gaseous nitrogen;

(h) feeding said seventh stream into a middle portion of said LP fractionator;

(i) expanding at least a portion of said eighth stream prior to feeding said eighth stream into an upper portion of said LP fractionator;

(j) combining a third portion of said first stream with said sixth stream to form a ninth stream;

(k) feeding said ninth stream into a lower portion of said LP fractionator and simultaneously fractionating said seventh stream, said eighth stream and said ninth stream in said LP fractionator under conditions sufficient to produce a high purity nitrogen overhead stream and a high purity methane bottom stream;

(l) recovering said overhead stream from said LP fractionator as a nitrogen product stream; and (m) recovering said bottom stream from said LP fractionator as a gas product stream.

2. A process in accordance with claim 1 additionally comprising the following steps:

reducing the pressure of said partially condensed second stream prior to said step of introducing said partially condensed second stream into said high pressure fractionator recited in paragraph (c); and reducing the pressure of said third stream and said second portion of said first stream prior to said step of combining recited in paragraph (d).

3. A process in accordance with claim 1 wherein the nitrogen content of said first stream is in the range of from about 37 mole-% to about 76 mole-%.

4. A process in accordance with claim 3 wherein said step of cooling a first stream recited in paragraph (a) comprises countercurrent flow heat exchange between said first stream and both said nitrogen product stream and said gas product stream.

5. A process in accordance with claim 1 further comprising dividing said gas product stream into a high pressure gas product stream and a low pressure gas product stream having a flow rate, and wherein a control valve is operably located to adjust said flow rate of said low pressure gas product stream, and wherein the actual temperature of said second stream is controlled to a desired value, said process additionally comprising the steps of:

establishing a first signal which is representative of the actual temperature of said second stream;

establishing a second signal which is representative of a desired temperature of said second stream;

comparing said first signal and said second signal and establishing a control signal which is responsive to the difference between said first signal and said second signal wherein said control signal is scaled so as to be representative of the position of said control valve required to maintain the actual temperature of said second stream essentially equal to the desired temperature represented by said second signal; and manipulating said control valve in response to said control signal.

6. A method of controlling the temperature of a nitrogen enriched vapor stream in an integrated dual distillation system, said method comprising the steps of:

(a) introducing a partially condensed feedstream comprising nitrogen and methane and essentially free of heavy hydrocarbons into a liquid/vapor phase separator and separating said partially condensed feedstream into a vapor phase and a liquid phase;

(b) withdrawing said nitrogen enriched vapor stream and a first stream comprising a methane enriched liquid from said liquid/vapor phase separator;

(c) separately introducing said nitrogen enriched vapor stream and said first stream into different portions of a first fractionator of said dual distillation system;

(d) simultaneously fractionating said nitrogen enriched vapor stream and said first stream in said first fractionator under conditions sufficient to produce a second stream predominantly comprising nitrogen and a third stream predominantly comprising methane;

(e) separately introducing said second stream and said third stream into different portions of a second fractionator of said dual distillation system;

(f) simultaneously fractionating said second stream and said third stream in said second fractionator under conditions to produce a high purity nitrogen overhead stream and a high purity liquid bottom stream;

(g) recovering said overhead stream from said second fractionator as a nitrogen product stream;

(h) elevating the pressure of said high purity methane stream and then dividing said high purity methane stream so that a first portion of said high purity methane stream forms a high pressure gas product stream and a second portion forms a low pressure gas product stream, wherein said low pressure gas product stream is produced by depressurizing said second portion of said high purity methane stream across a temperature control/expansion valve;

(i) cooling said feedstream by heat exchange with said low pressure gas product stream;

(j) establishing a first signal which is representative of the actual temperature of said nitrogen enriched vapor stream;

(k) establishing a second signal which is representative of the desired temperature of said nitrogen enriched vapor stream;

(l) comparing said first signal and said second signal and establishing a control signal which is responsive to the difference between said first signal and said second signal wherein said control signal is scaled so as to be representative of the position of said temperature control/expansion valve required to maintain the actual temperature of said nitrogen enriched vapor stream essentially equal to the desired temperature represented by said second signal; and (m) manipulating said temperature control/expansion valve in response to said control signal.

7. Apparatus for separating nitrogen and methane in a feed stream essentially free of heavy hydrocarbons and comprising a gaseous nitrogen-methane mixture at a pressure of at least 450 psia, said apparatus comprising:

a first cooling means;

means in fluid flow communication with said first cooling means for introducing a first portion of said feedstream into said first cooling means wherein said first portion of said feedstream is sufficiently cooled so as to produce a partially condensed feedstream;

first liquid/vapor phase separator means;

means in fluid flow communication between said first cooling means and said first liquid/vapor phase separator means for withdrawing said partially condensed feedstream from said first cooling means and for introducing said partially condensed feedstream into said first liquid/vapor phase separator means wherein said partially condensed feedstream is separated into a first stream comprising gaseous nitrogen-methane and a second stream comprising liquid nitrogen-methane;

second cooling means;

means in fluid flow communication between said first liquid/vapor phase separator means and said second cooling means for withdrawing said first stream comprising gaseous nitrogen-methane from said first liquid/vapor phase separator means and for introducing said first stream into said second cooling means wherein said first stream is sufficiently cooled so as to produce a partially condensed first stream;

first fractionator means;

means in fluid flow communication between said first liquid/vapor phase separator means and a lower portion of said first fractionator means for withdrawing from said first liquid/vapor phase separator means said second stream comprising liquid nitrogen-methane and for combining said second stream with a second portion of said feedstream to produce a third stream and introducing said third stream into said lower portion of said first fractionator means;

means in fluid flow communication between said second cooling means and an upper portion of said first fractionator means for withdrawing said partially condensed first stream from said second cooling means and for introducing said partially condensed first stream into said upper portion of said first fractionator means, wherein said first stream and said third stream are simultaneously fractionated under conditions sufficient to produce a fourth stream predominating in gaseous nitrogen and a fifth stream predominating in liquid methane;

third cooling means;

means in fluid flow communication between said first fractionator means and said third cooling means for withdrawing said fourth stream from said first fractionator means and for introducing said fourth stream into said third cooling means wherein said fourth stream is cooled sufficiently to produce a partially condensed fourth stream;

second liquid/vapor phase separator means;

means in fluid flow communication between said third cooling means and said second liquid/vapor phase separator means for withdrawing said partially condensed fourth stream from said third cooling means and for introducing said partially condensed fourth stream into said second liquid/vapor phase separator means wherein said partially condensed fourth stream is separated to produce a gaseous sixth stream and a liquid seventh stream;

second fractionator means;

means in fluid flow communication between said first fractionator means and a lower portion of said second fractionator means for withdrawing said fifth stream from said first fractionator means and for combining said fifth stream with a third portion of said feed stream to form an eighth stream and for introducing said eighth stream into said lower portion of said second fractionator means;

means in fluid flow communication between said second liquid/vapor phase separator means and an upper portion of said second fractionator means for withdrawing said sixth streams from said second liquid/vapor phase separator means and for expanding said sixth stream and introducing said thus expanded sixth stream into said upper portion of said second fractionator means;

means in fluid flow communication between said second liquid/vapor phase separator means and a middle portion of said second fractionator means for withdrawing said seventh stream from said second liquid/vapor phase separator means and for introducing said seventh stream into said middle portion of said second fractionator means; and wherein said seventh stream, said eighth stream and said ninth stream are simultaneously fractionated in said second fractionator means under conditions sufficient to produce an overhead stream comprising a high purity nitrogen product and a bottom stream comprising a high purity methane product.

8. Apparatus in accordance with claim 7 wherein:

said means for withdrawing said partially condensed first stream from said second cooling means and for introducing said partially condensed first stream into said upper portion of said first fractionator means comprises first expansion valve means interposed therein for expanding said partially condensed first stream; and said means for withdrawing from said first liquid/vapor phase separator means said second stream and for combining said second streams with a second portion of said feedstream to produce a third stream comprises second expansion valve means interposed therein for expanding said second stream prior to combining said second streams with said second portion of said feedstream, and third expansion valve means interposed therein for expanding said second portion of said feedstream prior to combining said second stream with said said second portion of said feedstream to produce said third stream.

9. Apparatus in accordance with claim 7, wherein:

said means for withdrawing said seventh stream from said liquid/vapor separator means and for introducing said seventh stream into said middle portion of said second fractionator means comprises first expansion valve means interposed therein for expanding said seventh stream; and said means fro withdrawing said fifth stream from said first fractionator means and for introducing said fifth stream into said lower portion of said second/fractionator means comprises second expansion valve means interposed therein for expanding said fifth stream.

10. Apparatus in accordance with claim 7 additionally comprising:

conduit means in fluid flow communication with said second fractionator means for withdrawing said high purity methane product bottoms stream from said second fractionator means and for dividing said high purity methane product stream into a first product stream conduit and a second product stream conduit; and control valve means, operably located in said second product stream conduit, having an inlet and an outlet, for establishing a pressure reduction at said outlet of said control valve means and thereby providing a low pressure gas product stream.

11. Apparatus in accordance with claim 10, additionally comprising;

first signal means operatively related to said means for withdrawing a first stream from said first liquid/vapor phase separator means and for introducing said first stream into said second cooling means for establishing a first signal which is representative of the actual temperature of said first stream;

second signal means for establishing a second signal which is representative of a desired temperature of said first stream;

controller means operatively related to said first signal means and said second signal means for comparing said first signal and said second signal and for establishing a control signal which is responsive to the difference between said first signal and said second signal wherein said control signal is scaled so as to be representative of the position of said control valve means required to maintain the actual temperature of said first stream essentially equal to the desired temperature represented by said second signal; and means operatively interconnecting said controller means and said control valve means for manipulating said control valve means in response to said control signal.

* * * * *